US006450825B1

(12) United States Patent
Huang

(10) Patent No.: US 6,450,825 B1
(45) Date of Patent: Sep. 17, 2002

(54) ZIF SOCKET WITH INDICATOR MECHANISM

(75) Inventor: Yao-Chi Huang, Yung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/993,081

(22) Filed: Nov. 13, 2001

(30) Foreign Application Priority Data

Aug. 10, 2001 (TW) ..... 90213709 U

(51) Int. Cl.[7] ..... H01R 13/625
(52) U.S. Cl. ..... 439/342; 439/488
(58) Field of Search ..... 439/259–270, 439/342, 488, 489

(56) References Cited

U.S. PATENT DOCUMENTS 6,071,140 A * 6/2000 McHugh et al. ..... 439/342
6,200,154 B1 * 3/2001 Yu ..... 439/342
6,231,366 B1 * 5/2001 Pei et al. ..... 439/342
6,338,646 B1 1/2002 Hara et al.

* cited by examiner

*Primary Examiner*—Brian Sircus
*Assistant Examiner*—Son V. Nguyen
(74) *Attorney, Agent, or Firm*—Wei Te Chung

(57) ABSTRACT

A ZIF socket (1) comprises a base (10), a cover (20) movably mounted on the base, an actuator (30) for driving the cover to move along the base, and an indicator (40). The base defines an array of contact holes (12) for receiving a corresponding number of conductive contacts (50) therein. The cover defines an array of pin holes (22) corresponding to the contact holes of the base for insertion of pins of a CPU mounted thereon. The indicator engages with the actuator and has an indicative portion (42) which extends out of the cover.

11 Claims, 7 Drawing Sheets

ZIF SOCKET WITH INDICATOR MECHANISM

BACKGROUND OF THE INVENTION

1. Field of the Invention

The present invention generally relates to a Zero Insertion Force (ZIF) socket, and particularly to a ZIF socket having an indicator mechanism to indicate the working status thereof.

2. Description of Related Art

Commonly, a ZIF socket is adapted for electrically connecting an integrated circuit (IC) package, such as a Central Processing Unit (CPU), with a mother board. Referring to FIG. 7, a conventional ZIF socket comprises a rectangular base 5, a cover 6 movably mounted on the base 5, and an actuator 7 for driving the cover 6 to move along the base 5. The base 5 defines an array of first through holes 51 for receiving conductive contacts (not shown) therein and a circular opening 52 at one end thereof. The cover 6 defines an array of second through holes 61 corresponding to the first through holes 51 for insertion of pins of a CPU (not shown) mounted thereon, and an elliptical opening 62 corresponding to the circular opening 52 of the base 5. The actuator 7 comprises a first cylinder 71 and a second cylinder 72 eccentrical to the first cylinder 71 for rotatably received in the opening 52 and the elliptical opening 62, respectively. In use, a screwdriver (not shown) is applied onto the second cylinder 72 to drive the actuator 7 to rotate, thereby driving the cover 6 to move relative to the base 5 from an open position where the pins are disconnected from the conductive contacts to a closed position where the pins are electrically connected with the conductive contacts. However, there is no indicator means provided to indicate whether the ZIF socket is in an open position or in a closed position. Therefore, it is difficult for the user to identify the working status of the socket, and the socket may be damaged if the user operates improperly.

An improved design to solve the problem described above is to extend a block from a sidewall of the second cylinder 72. The block rotates with the actuator 7 when the actuator 7 drives the cover 6 to move along the base 5. The user can identify the working status by identifying the position of the block. However, since the socket usually has a heat sink assembled thereon in use, the block will be covered up by the heat sink and the user still cannot identify the working status.

Hence, an improved ZIF socket is required to overcome the disadvantages of the prior art.

SUMMARY OF THE INVENTION

The object of the present invention is to provide a ZIF socket having an indicator mechanism to facilitate identification by the user of the working status thereof.

To fulfill the above mentioned object, a ZIF socket in accordance with the present invention comprises a base, a cover movably mounted on the base, an indicator, and an actuator fitted in the cover and the base for driving the cover to move along the base between an open position and a closed position. The base defines an array of contact holes for receiving a corresponding number of conductive contacts therein. The cover defines an array of pin holes corresponding to the contact holes of the base for insertion of pins of a CPU mounted thereon. The indicator engages with the actuator and has an indicative portion longitudinally extending out of the cover in other the open position or the closed position.

Other objects, advantages and novel features of the invention will become more apparent from the following detailed description of the present embodiment when taken in conjunction with the accompanying drawings.

DETAILED DESCRIPTION OF THE INVENTION

Figure 1:
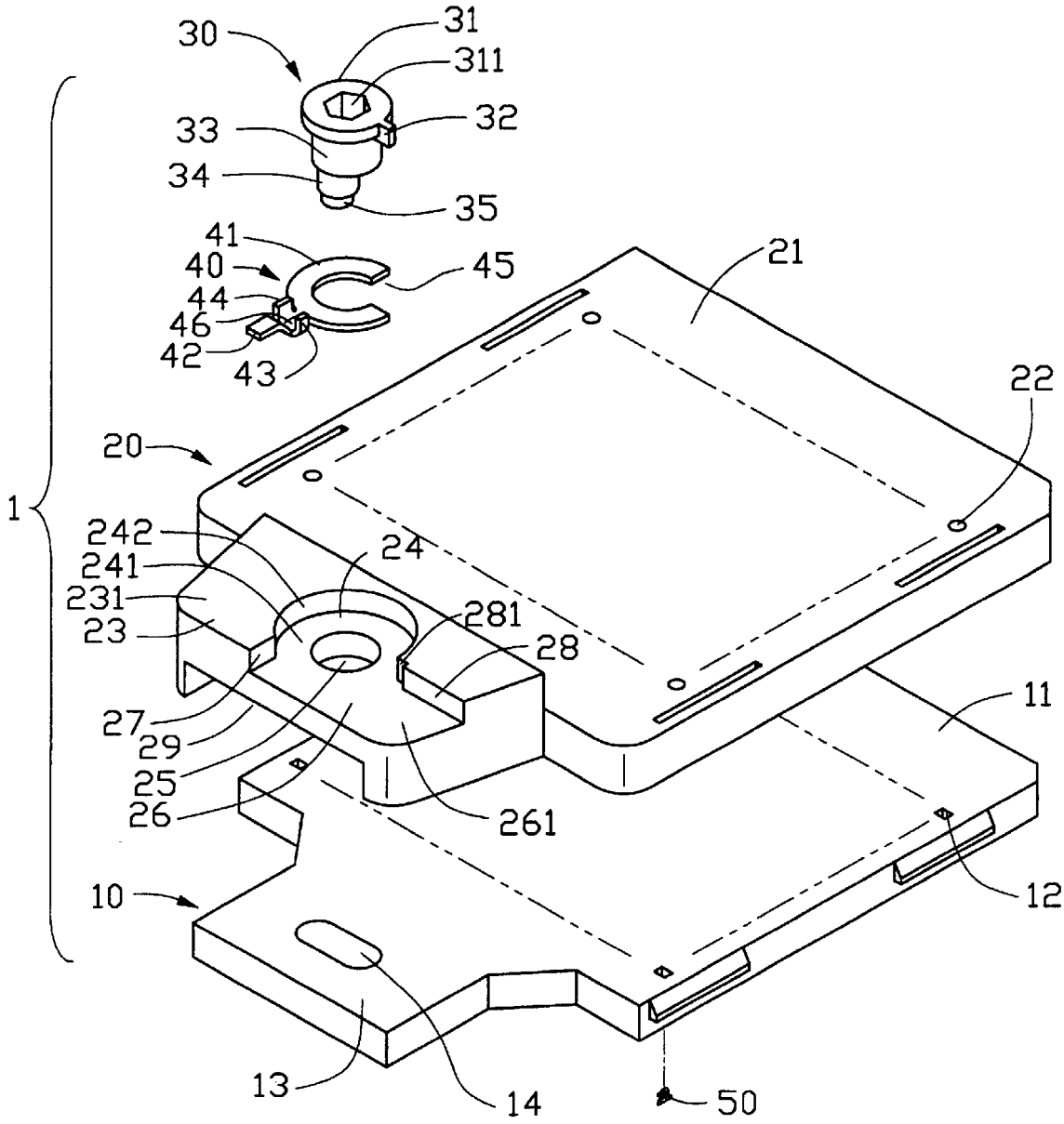
FIG. 1 is an exploded perspective view of a ZIF socket in accordance with the present invention.

Referring to FIG. 1, a ZIF socket 1 in accordance with the present invention comprises a base 10, a cover 20 movably mounted on the base 10, an actuator 30 and an indicator 40.

The base 10 has a substantially rectangular insulative housing 11 made of plastic or the like. The insulative housing 11 defines an array of contact receiving holes 12 for receiving corresponding conductive contacts 50. A protruding plate 13 extends from one end of the base 10 and defines an elliptical hole 14 in the center.

The cover 20 is movably mounted on the base 10 and comprises a rectangular housing 21 and a plurality of pin holes 22 vertically defined therein in alignment with the contact receiving holes 12. The cover 20 has a ledge 23 at one end thereof corresponding to the protruding plate 13. The ledge 23 defines a recess 24 in a center part of an upper surface 231 thereof and a circular hole 25 in a bottom surface 241 of the recess 24 corresponding to the elliptical hole 14. The ledge 23 also defines a cutout 26 at a comer thereof and communicating with the recess 24. A pair of stoppers or sidewalls 27, 28 are defined between the upper surface 231 of the ledge 23 and the bottom surface 261 of the recess 26. The stopper 28 has a depression 281 adjacent to the sidewall 242 of the recess 24. The ledge 23 defines a receiving recess 29 in a bottom side thereof for receiving the protruding plate 13 of the base 10.

The actuator 30 is fitted in the cover 20 and the base 10 and comprises a first cylinder 31, a second cylinder 33, a third cylinder 34 and a fourth cylinder 35 sequentially formed from top to bottom. The diameters of the cylinders 31, 33, 34, 35 are reduced sequentially. The first cylinder 31 defines a central slot 311 extending along its axial direction for receiving a screwdriver (not shown). A protrusion 32 is formed on the actuator 30 and comprises a first portion 321 and a second portion 322 (FIG. 2) extending from the first cylinder 31 and the second cylinder respectively. The first and second cylinders 31, 33 have a common first axis, and the third and fourth cylinders 34, 35 have a common second axis offset from the first axis. The first, second and third cylinders 31, 33, 34 are received in the recess 24, the circular hole 25 of the cover 20 and the elliptical hole 14 of the base 10, respectively. By applying the screwdriver, the protrusion 32 can rotate along the inner wall of the recess 24, and the second cylinder 33 can rotate in the circular hole 25. When the third cylinder 34 rotates in the elliptical hole 14 of the base 10, the cover 20 slides from an open position where the pins of the CPU are disconnected from the conductive contacts 50 to a closed position where the pins are electrically connected with the conductive contacts 50. The fourth cylinder 35 runs through the elliptical hole 14 and rivets with a metal pad (not shown) for retaining the actuator 30 after it is assembled in the cover 20 and base 10.

Figure 2:
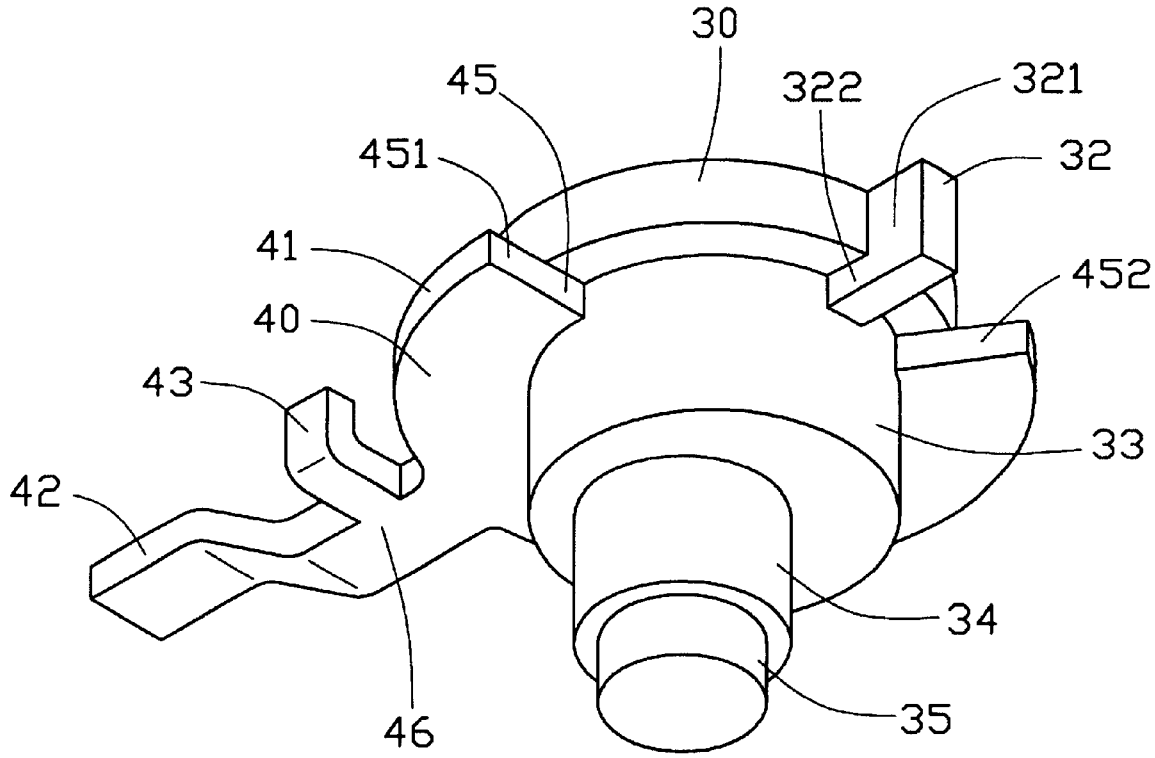
FIG. 2 is an assembled perspective view of an actuator and an indicator of the ZIF socket shown in FIG. 1.
Figure 3:
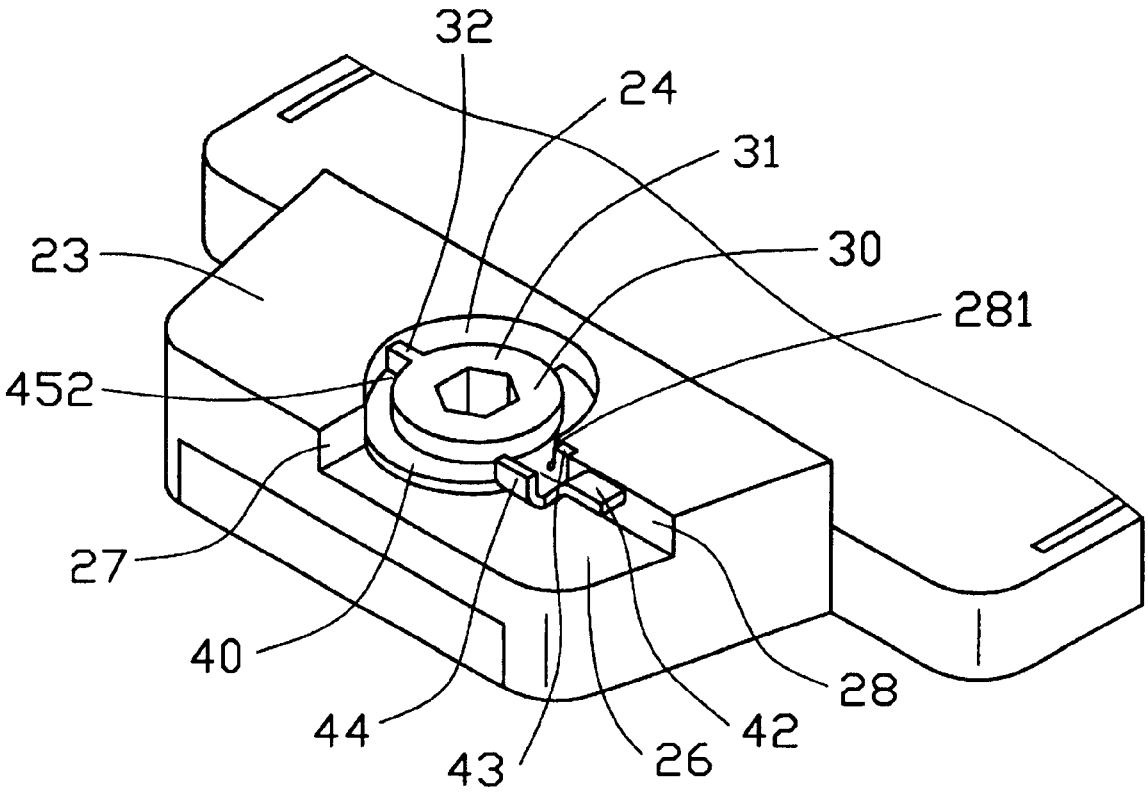
FIG. 3 is a partial perspective view of the ZIF socket with a cover thereof in an open position.

Referring to FIGS. 2 and 3, the indicator 40 is confined in the recess 24 by the first cylinder 31 and comprises an annular gasket 41. The washer 41 encircles the second cylinder 33 right below the first cylinder 31 and defines an opening 45 spanning about 90°. The washer 41 has two ends 451 and 452 on opposite sides of the opening 45. An engaging portion 46 extends from an outer periphery of the washer 41. An indicative portion 42 extends upwardly and outwardly from the engaging portion 46. The engaging portion 46 comprises a first support portion 43 and a second support portion 44 at opposite sides thereof for respectively engaging with the depression 281 and the stopper 27. The second support portion 44 is wider than the first support portion 43.

In assembly, the cover 20 is mounted on the base 10 with the receiving recess 29 receiving the protruding plate 13 therein, and the indicator 40 is assembled to the cover 20 with the washer 41 in the recess 24 of the cover 20 and with the indicative portion 42 and the engaging portion 46 in the cutout 26. The actuator 30 is then inserted into the cover 20 and the base 10 by sequentially extending through the recess 24, the circular hole 25 of the cover 20 and the elliptical hole 14 of the base 10. The protrusion 32 of the actuator 30 is placed between the ends 451, 452 of the washer 41 of the indicator 40. Finally, the metal pad is riveted with the fourth cylinder 35 for securing the actuator 30 in position.

Figure 4:
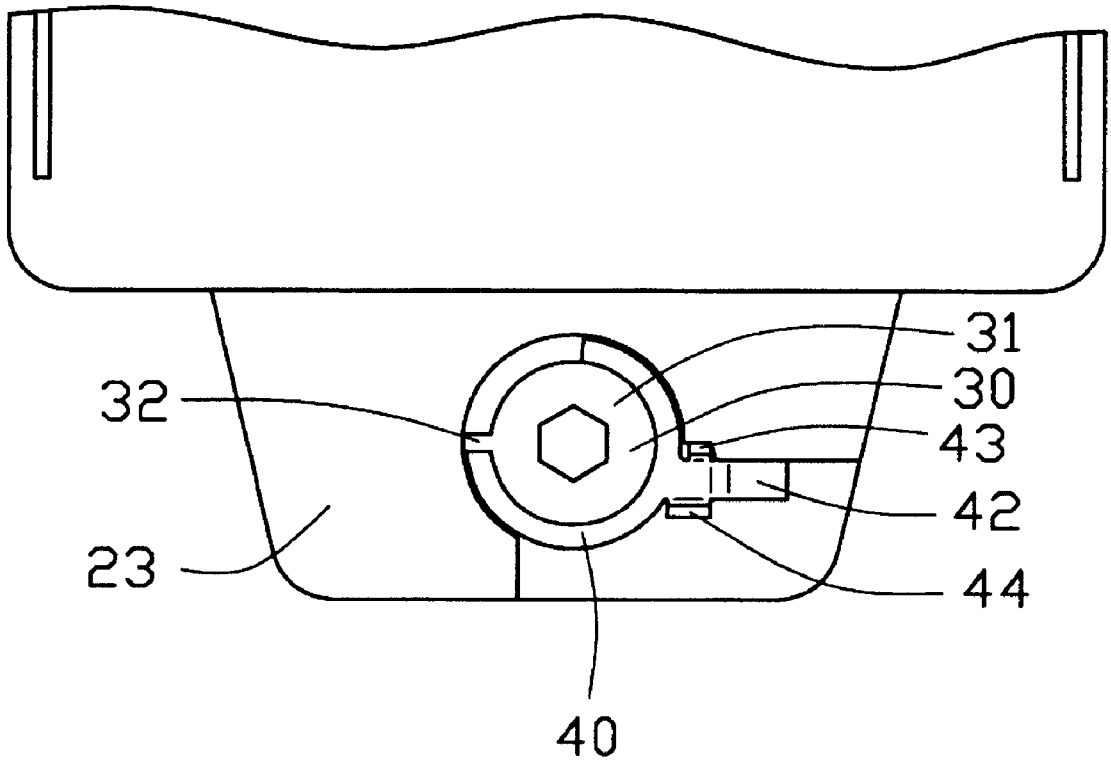
FIG. 4 is a top plan view of FIG. 3.
Figure 5:
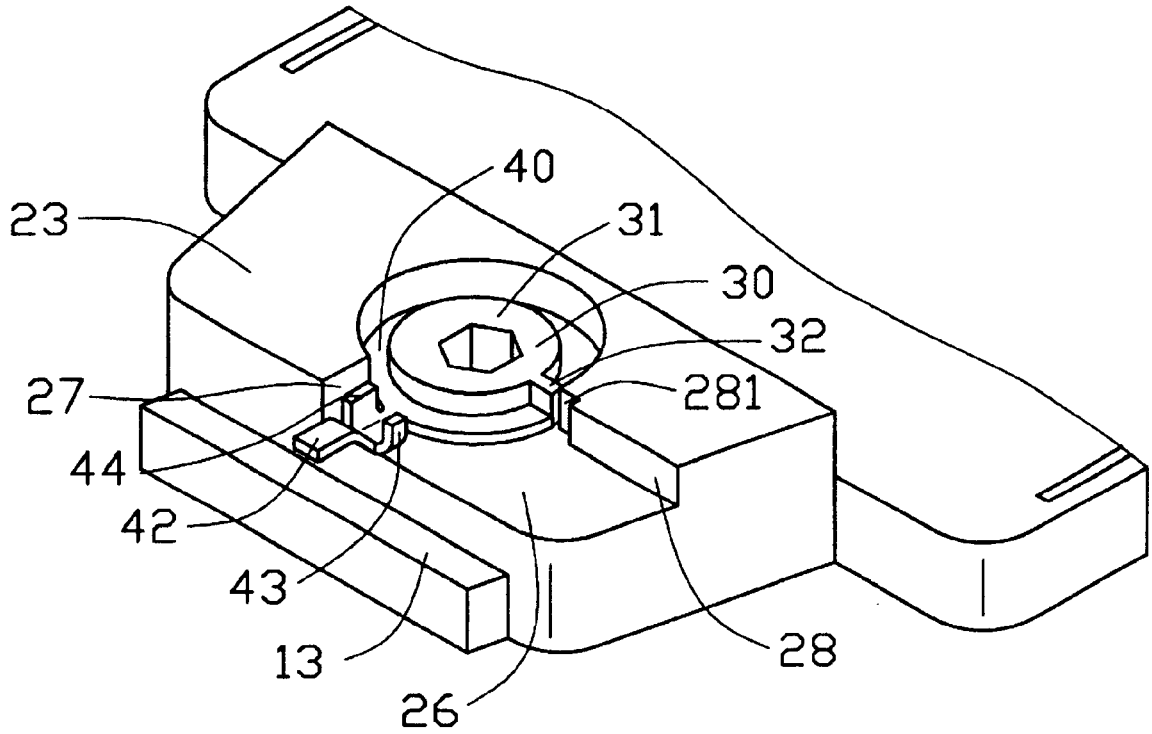
FIG. 5 is a partial perspective view of the ZIF socket with the cover in a closed position.
Figure 6:
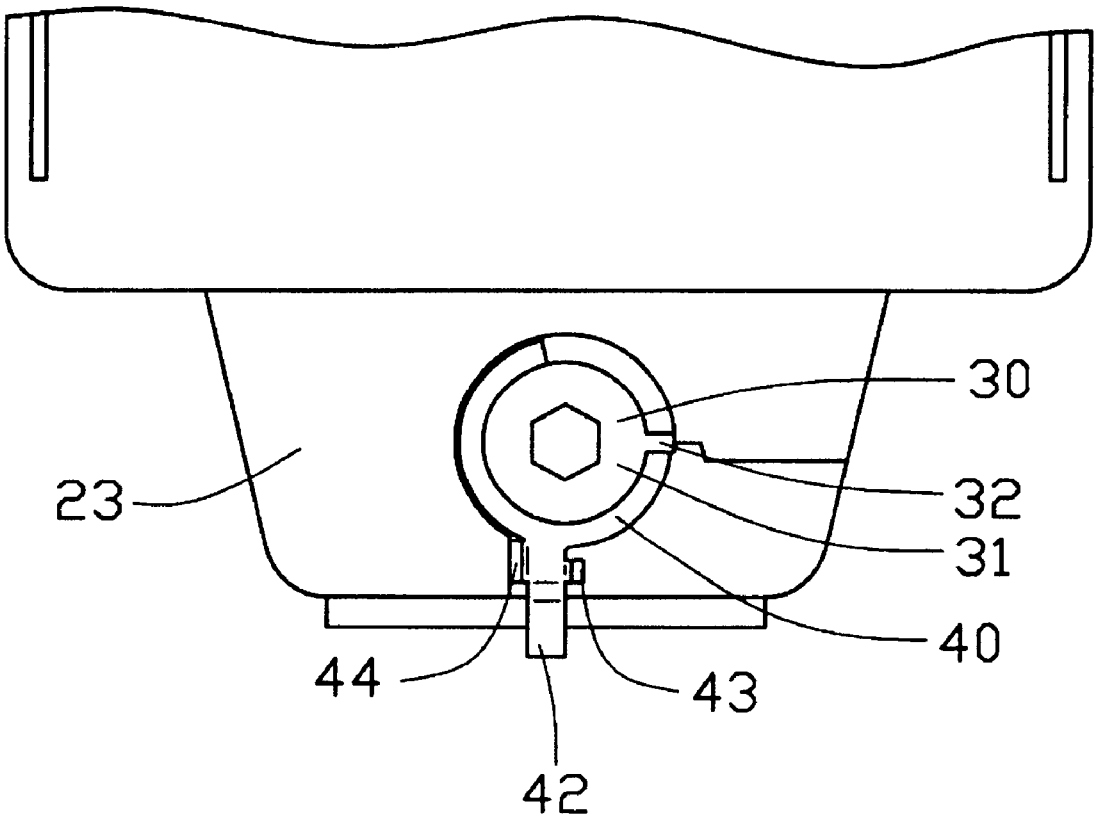
FIG. 6 is a top plan view of FIG. 5.
Figure 7:
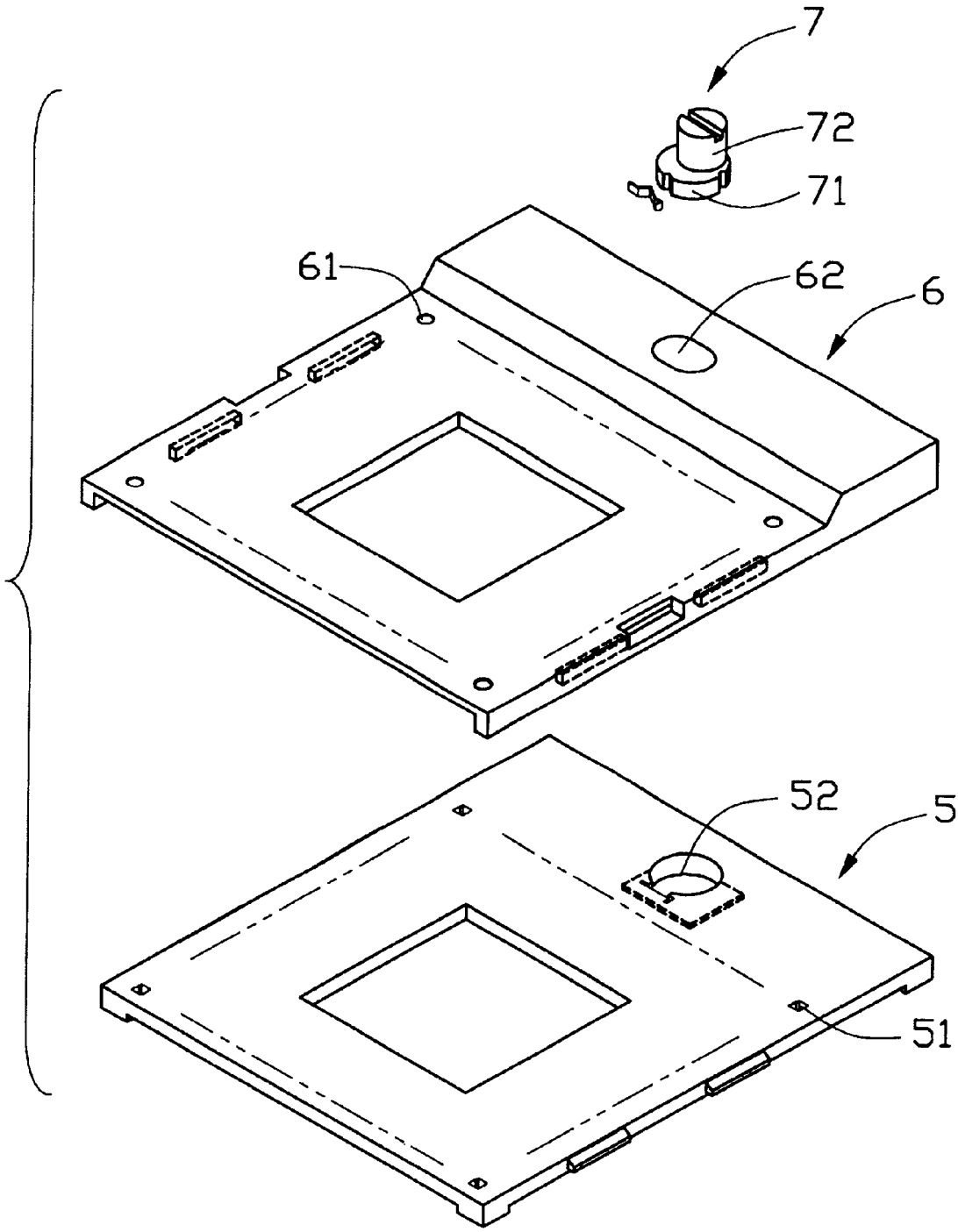
FIG. 7 (PRIOR ART)
FIG. 7 is an exploded perspective view of a conventional ZIF socket.

Referring to FIGS. 3 and 4, the ZIF socket 1 is in an open position where the pins of the CPU are disconnected from the conductive contacts 50 of the socket. The end 452 of the indicator 40 abuts against the protrusion 32, the first support portion 43 is received in the depression 281, and the second support portion 44 and the indicative portion 42 are located in the cutout 26. The cover 20 is movable along the base 10 by rotating the actuator 30, whereby the second portion 322 of the protrusion 32 disengages from the end 52 of the indicator and abuts against the end 451 of the indicator 40 to drive the indicator 40 to rotate. Referring to FIGS. 5 and 6, when the actuator 30 arrives at a closed position the pins of the CPU are connected with the conductive contacts 50 of the socket, the second support portion 44 of the indicator 40 abuts on the stopper 27, and the indicative portion 42 can now be turned to extend outwardly from the ledge 23. Thus, the operator can see the indicative portion 42 to identify the working status of the ZIF socket.

Althrough the above preferred embodiment of the present invertion discloses that the indicative portion 42 of the indicator 40 extends out of the cover 20 in the closed position, it should be understood that modification may be made to the components of the present invention so that the indicative portion 42 could extend outwardly in the open position, which is well within the skill of one ordinary artisan. Additionally, in this embodiment the indicator 40 is a separate piece from the actuator 30. Alternately, the indicator 40 may be fastened with or integrally formed with the indicator as one piece to move, as long as the indicative portion 42 may be exposed to an exterior outside the boundaries of one of the base and the cover. Moreover, in this embodiment, the indicator 40 is directly urged to move by the actuator 30. Alternately, the indicator may be indirectly urged to move by the actuator 30 when the actuator 30 actuates the cover 20 to move along a front-to-back direction, as long as the indicative portion 42 may protrude out of the outer contours of at least one of the base 10 and the cover 20, where the indicative portion 42 may be visible from the top even though a heat sink is staked upon the cover 20. Yet, in this embodiment the indicator 40 itself directly extends out of the outer contours of the cover 20. Instead, in another embodiment the indicator itself does not directly extend out of the outer contours of the cover but actuating another piece, which defines a path not limited with rotation, to extend to an exterior for observation via a bar linkage mechanism.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A zero insertion force (ZIF) socket for connecting an Integrated Circuit (IC) package to a mother board, comprising:

a base defining an array of contact holes;

a plurality of conductive contacts received in the contact holes;

a cover movably assembled on the base and defining an array of pin holes in alignment with the contact holes of the base adapted for insertion of pins of the IC package, the cover being movable between an open position where the pins of the IC package are disconnected from the conductive contacts and a closed position where the pins of the IC package are connected with the conductive contacts;

an actuator received in the cover and the base for driving the cover to move along the base in a longitudinal direction, the actuator comprising a first cylinder, a second cylinder, a third cylinder and a fourth cylinder sequentially formed thereon, the first and second cylinders having a common first axis, the third and fourth cylinders having a common second axis offset from the first axis; and an indicator engaged with the actuator and having an indicative portion longitudinally extending out of the cover in either the open position or the closed position, said indicator including an annular washer through which the actuator extends with the second cylinder received therein, said washer further defining two opposite ends engageable with a protrusion of the actuator.

2. The ZIF socket as described in claim 1, wherein the base comprises a protruding plate defining an elliptical hole receiving the third cylinder of the actuator.

3. The ZIF socket as described in claim 1, wherein the cover has a ledge corresponding to the protruding plate, the ledge defining a recess in an upper surface of the ledge to receive the first cylinder of the actuator, a hole below and communicating with the recess receiving the second cylinder of the actuator, and a cutout at a corner of the ledge and in communication with the recess.

4. The ZIF socket as described in claim 3, wherein the ledge comprises a pair of stoppers formed between the upper surface of the ledge and a bottom surface of the recess, and a depression defined between the recess and one of the stoppers.

5. The ZIF socket as described in claim 4, wherein the annular washer is received in the recess of the cover below the first cylinder of the actuator and an engaging portion outwardly extends from the washer, and wherein the indicative portion outwardly extends from the engaging portion, the engaging portion and the indicative portion being received in the cutout of the cover.

6. The ZIF socket as described in claim 5, wherein the protrusion of the actuator has a first portion and a second portion respectively extending from the first and second cylinders of the actuator.

7. The ZIF socket as described in claim 6, wherein the washer has an opening spanning about 90° and said two ends are located on opposite sides of the opening, and wherein the second portion of the protrusion is received in the opening and engageable with the two ends of the washer.

8. The ZIF socket as described in claim 7, wherein the engaging portion of the indicator comprises a first support portion and a second support portion upwardly extending from opposite sides of the engaging portion, the first support portion being receivable in the depression of one of said stoppers, the second support portion being engageable with the other stopper.

9. A socket for connecting an Integrated Circuit (IC) package to a mother board, comprising:

a base defining an array of contact holes, a plurality of contacts received within the contact holes, respectively;

a cover movably assembled on the base and defining an array of pin holes in alignment with the contact holes of the base adapted for insertion of pins of the IC package, the cover being movable between an open position where the pins of the IC package are disconnected from the conductive contacts and a closed position where the pins of the IC package are connected with the conductive contacts;

an actuator received in the cover and the base for driving the cover to move along the base in a longitudinal direction, the actuator comprising a first cylinder, a second cylinder, a third cylinder and a fourth cylinder sequentially formed thereon, the first and second cylinders having a common first axis, the third and fourth cylinders having a common second axis offset from the first axis; and an indicator being moveable when the cover is moved relative to the base, said indicator having an indicative portion extending out of outer contours of at least one of the base and the cover when said cover is in one of the open position and the closed position while the indicative portion embedded within the outer contours of said at least one of the base and the cover when said cover is in the other of the open position and the closed position, said indicator including an annular washer through which the actuator extends with the second cylinder received therein, said washer filer defining two opposite ends engageable with a protrusion of the actuator, wherein said indicator is a separate part from the actuator.

10. The socket as described in claim 9, wherein the actuator and the indicator rotate with different angles when said cover moves between the closed position and the open position.

11. The socket as described in claim 9, wherein said indicative portion is integrally formed with the indicator.

* * * * *